United States Patent [19]

Sirinyan et al.

[11] Patent Number: 4,661,384

[45] Date of Patent: Apr. 28, 1987

[54] PROCESS FOR ACTIVATING SUBSTRATE SURFACES FOR ELECTROLESS METALLIZATION

[75] Inventors: Kirkor Sirinyan, Bergisch Gladbach; Rudolf Merten, Leverkusen; Gerhard D. Wolf, Dormagen, all of Fed. Rep. of Germany

[73] Assignee: Bayer Aktiengesellschaft, Leverkusen, Fed. Rep. of Germany

[21] Appl. No.: 746,913

[22] Filed: Jun. 20, 1985

[30] Foreign Application Priority Data

Jun. 29, 1984 [DE] Fed. Rep. of Germany ..... 3424065

[51] Int. Cl.[4] ..... C23C 18/30

[52] U.S. Cl. ..... 427/304; 106/1.11; 427/305; 427/301

[58] Field of Search ..... 427/306, 304, 305; 106/1.11

[56] References Cited

U.S. PATENT DOCUMENTS

| | | | |
|---|---|---|---|
| 3,501,332 | 3/1970 | Buckman | 427/306 |
| 3,560,257 | 2/1971 | Schneble | 427/306 |
| 3,993,807 | 11/1976 | Stabenow et al. . | |
| 4,367,072 | 1/1983 | Vögtle | 436/815 |
| 4,575,467 | 3/1986 | Sirinyan | 427/306 |

FOREIGN PATENT DOCUMENTS

| | | |
|---|---|---|
| 2934584 | 3/1981 | Fed. Rep. of Germany . |
| 1154152 | 6/1969 | United Kingdom . |

OTHER PUBLICATIONS

B:Pharmaceuticals-BOEF B04 27458 C/16=US 4367-072 6830T-AEM A35-E12-M13-SCHD.30-0-3-71.

IUPAC Pure and Applied Chemistry, vol. 43, Nos. 1-2-p. 327.

Annual Reports on the Progress of Chemistry, vol. 80, 1983, p. 353.

*Primary Examiner*—John D. Smith

*Attorney, Agent, or Firm*—Sprung Horn Kramer & Woods

[57] ABSTRACT

Activation baths containing an organometallic compound based on elements of sub-group 1 or 8 of the periodic table with a "guest/host" interrelationship are outstandingly suitable for electroless metallization of preferably non-metallic substrates. Activators of palladium compounds and cyclic crown ethers are particularly suitable.

7 Claims, No Drawings

PROCESS FOR ACTIVATING SUBSTRATE SURFACES FOR ELECTROLESS METALLIZATION

It is known that solutions or dispersions of salts of elements of sub-group 1 or 8 of the periodic table of the elements in polar organic solvents can be used for activation of non-metallic substrates for wet chemical metallisation (compare, for example, Great Britain Patent Specification No. 1,154,152 and German Patent Application No. A-2,934,584).

These processes have the disadvantage that they require prior etching of the substrate surface to be metallised, are suitable only for certain substrates, such as, for example, acrylonitrile/butadiene/styrene copolymers, require an additional complexing or reducing step, and cannot be carried out in aprotic solvents which dry rapidly, since the noble metal salts are insoluble in these solvents.

It is furthermore known that solutions or dispersions of the Pd-O complexes of $\alpha,\beta$-unsaturated ketones (compare German Patent Application No. A-2,451,217) or of the complexes of N-containing compounds (compare German Patent Application No. A-2,116,389) can also be used for the activation of substrate surfaces. However, these processes also require oxidative degradation treatment of the surfaces to be metallised, which means that their industrial application is also restricted only to certain substrates. In addition, the surfaces must also be after-treated with the aid of reducing or complexing agents, to allow electroless deposition of metal by catalysis in the subsequent metallisation step. Moreover, the systems mentioned have the disadvantage that they are sufficiently soluble only in comparatively toxic aromatics and not in the commercially available solvents, such as 1,1-dichloroethane, trichloroethylene, ethanol and cyclohexane, and they have an inadequate storage stability.

Water-containing activation baths containing reaction products of noble metal-halogen complexes with polyglycol (ethers) are furthermore known from German Patent Application No. A-2,934,584. These activation solutions have, inter alia, the disadvantage that the substrates treated with them must be heated or treated with washing baths before the metallisation, because of the high boiling points of the polyglycols, which means that some of the activator is lost.

Finally, elegant activation systems based on complex compounds of elements of sub-group 1 or 8 of the periodic table which have an additional functional grouping to improve adhesion are known (compare German Patent Application No. A-3,148,280). With the aid of functional groups matched to the particular substrate, various substrates, such as glass, ceramics and polyester, polyamide and ABS plastics, can be provided with an adhesive metal coating without prior etching. However, these elegant activation systems also have the disadvantage that they have only a limited storage stability, at best of a few months, under the usual conditions of the technique of electroplating plastics. Furthermore, this limited storage stability is only ensured if the activators are dissolved in particularly purified solvents.

For these reasons, technical grade solvents, which contain the usual impurities, stabilisers and foreign ions, must be freed from these constituents with a great deal of effort, which additionally increases the process costs.

Another disadvantage of these systems is that they cannot be used in solvents which are of industrial interest but are capable of complex formation, such as dimethylformamide (DMF), dimethylsulphoxide (DMSO), methyl ethyl ketone and pentane-2,4-dione. In particular, as a result of additional complex formation, they are stabilised in these media to the extent that they no longer exhibit catalytic action.

The present invention is thus based on the object of developing activation systems which are based on organo-metallic compounds of the elements of sub-groups 1 and 8 of the periodic table and are preferably readily soluble in aprotic solvents and have a virtually unlimited storage stability, and which are additionally distinguished by their excellent stability towards moisture, atmospheric oxygen, the usual solvent stabilisers and impurities and which have activation properties which are virtually uninfluenced by the above solvents which are capable of complex formation.

According to the invention, this object is achieved by using, as the organometallic compounds, those with a "host/guest" interrelationship.

Compounds consisting of selective complex ligands or host molecules and the guest ion or molecule to be complexed are generally known.

Possible selective complex ligands are cyclic or acyclic compounds which, because of their chemical and/or physical nature, are a host molecule or, in the presence of ionic or neutral compounds to be complexed, assume the form required for complex or adduct formation, the polar regions being directed towards the complexing medium in the presence of this medium.

As is known, the selectivity of the host molecule towards the guest ion or molecule to be complexed depends on the ring size, steric build-up or chemical nature (whether polar or hydrophobic) thereof. Numerous selective host molecules which can form a selective guest/host complex with the alkali metal or alkaline earth metal cations, such as $Li^+$, $Na^+$, $K^+$, $Ca^{2+}$ or $NH_4^+$ [compare E. Weber, "Kontakte" ("Catalysts") (Darmstadt) 1, (1984) and J. G. Schindler, "Bioelektrochemische Membranelektroden" ("Bioelectrochemical membrane electrodes"), pages 77–104, Walter de Gruyter Verlag, Berlin/New York 1983)] or with heavy metal ions, such as $Co^{2+}$, $Ni^{2+}$, $Fe^{3+}$, $Cd^{2+}$ and $Ag^+$, and with anions, such as $Cl^-$ and $SO_4^{2-}$ [compare the abovementioned work of J. G. Schindler, pages 104–112] and with neutral ligands or compounds have been described in the literature.

All host complex ligands containing hetero-atoms (O, N and S) in their chain are suitable for carrying out the new process according to the invention. Particularly suitable ligands or crown ethers, cryptands or podands, or derivatives thereof, as well as cyclic peptides; and furthermore tetrahydrofuran-containing, esterlinked macrolides and analogous compounds which are based on hetero-atoms, such as S and N, and are known, for example, as transport regulators in biological systems.

A definition of the terms "crown ethers", "cryptands" and "podands" can be found in the reviews of F. Vögtle, "Kontakte" ("Catalysts") (Darmstadt) (1977) and (1978), E. Weber, "Kontakte" ("Catalysts") (Darmstadt) (1984) and Vögtle Chemikerzeitung 97, 600–610 (1973).

Substituted or unsubstituted host ligands based on cyclic or acyclic crown ethers, which can also additionally contain hetero-atoms, such as N and S in their ring system, are particularly preferably employed for carrying out the process according to the invention. Such compounds are described in German Patent Application No. A-2,842,862 and European Patent Application No. A-10,615 and correspond, for example, to the formulae

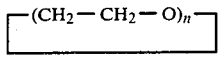

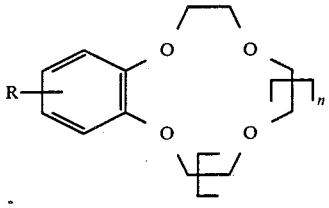

n=0–4

R=alkyl, aryl, halogen and the like

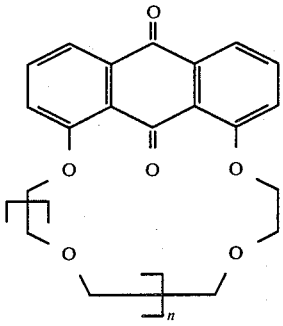

n=0–4

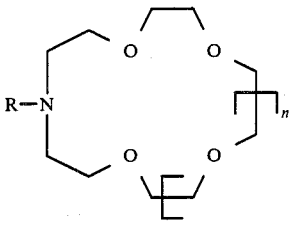

n=0–4

R=alkyl or aryl; for example methyl, ethyl, phenyl, biphenyl, phenylazophenyl and the like.

The abovementioned cyclic compounds are preferred.

Another variant for carrying out the process according to the invention comprises covalently incorporating the host molecules mentioned into polymeric or oligomeric compounds and then complexing them with the desired activation media. Such oligomeric or polymeric systems are known and are described, for example, in "Novel Polyurethanes with Macroheterocyclic (Crown-Ether) Structures in the Polymer Backbone", J. E. Herweh, J. of Polymer Science: Polymer Chemistry Edition, Vol. 21, 3101 (1983).

The inorganic part of the host/guest molecules is preferably formed (1) from compounds of the formula $$Me^{n+}E^{m+}Hal_z^-$$

wherein

Me represents hydrogen, alkali metal or alkaline earth metal atoms or heavy metal atoms (Fe, Co, Ni or Cu) or represents $NH_4$, Hal represents halogen (preferably Cl or Br) and E represents a noble metal atom of sub-group 1 or 8 of the periodic table (preferably Pt, Pd or Au) with a valency of m and a coordination number of z, wherein $$z-m=n, \text{ or}$$

(2) from cations of the said elements, preferably $Ag^+$, $Cu^{2+}$ or $Cu^+$, or, preferably, (3) from non-complexing salts of the elements of the formula $$E^{m+}Hal_p^-(p=m)$$

or (4) from customary colloidal systems of these noble metals.

Noble metal compounds which are preferably to be used are those of the formula $H_2PdCl_4$, $Na_2(PdCl_2Br_2)$, $Na_2PdCl_4$, Ca $PdCl_4$, $Na_4(PtCl_6)$, $AgNO_3$, $HAuCl_4$ and CuCl. The Pd compounds are preferred.

Suitable colloidal noble metal systems are derived, above all, from the metals Pd, Pt, Au and Ag and are described, for example, in "Kunststoffgalvanisierung" ("Electroplating of plastics") by R. Weiner and G. Eugen, Leuze Verlag, Saulgau, Württ. (1973), pages 180–209.

For the case described in point 1), the electrically neutral ligand takes up the cation $M^{n+}$ in its endohydrophilic hollow space at the phase boundary and transports it into the organic solvent phase, the portion $[E^{m+}\ Hal_z^-]$ also being transported into the desired solvent phase due to the resulting potential gradient. In principle, this phenomenon is also relevant to the systems described in points (2), (3) and (4).

The activation solution can be prepared by dissolving the host molecule in a suitable aprotic solvent with boiling point at 80° C., such as perchloroethylene, 1,1,1-trichloroethane, $CH_2Cl_2$, petroleum ether or chloroform, and adding the noble metal system, in accordance with the principle already mentioned.

Another possibility for preparing the activation systems according to the invention comprises a procedure in which the said noble metals are taken in an aqueous phase and, again in accordance with the principle mentioned, are allowed to diffuse into and complex in an organic phase containing the host molecules which are capable of complex formation, the organic phase is separated from the aqueous phase and is washed neutral, if appropriate, and freed from the solvent by recrystallisation or evaporation, and the residue is then used for the activation in a desired liquid medium.

Although such systems have an unlimited storage stability in protic and aprotic solvents under the usual conditions in the technique of electroplating plastics, they have, surprisingly, good activation properties for electroless chemical metallisation.

Since they diffuse decidedly well both in microporous and macroporous membrane matrices and in inorganic porous solids, they are outstandingly suitable both for metal doping and for activation for subsequent continuous electroless metallisation of such porous systems.

The activators to be used according to the invention diffuse in microscopic hollow spaces (free volumes) of the usual polymers, which means that an additional adhesion of the activation nuclei or metal coatings deposited by the electroless method is achieved. The precise definition of the "free volume theory" can be found in the review by J. Crank "The Mathematics of Diffusion" Oxford University Press, London (1975).

The activators can be employed in concentration ranges from 0.001 g/l (based on the noble metal) to the particular solubility limit. Preferably, 0.1 to 3.0 g/l of these substances are used.

Thanks to their high storage stability (no turbidity of the solutions—in some cases after storage for weeks) and their intense absorption in the ultraviolet and/or visible range of the spectrum, they are outstandingly suitable for continuous concentration monitoring with a photometer.

The absorption properties of the complex compounds to be used according to the invention can moreover be increased further by introducing specific substituents (in particular $NO_2$, $—NR_3$, $—SO_3H$ and —CN).

The influence of electron-attracting or electronshifting substituents on the light absorption properties of carbon molecules is known and can be found, for example, in D. H. Williams and J. Flemming "Spektroskopische Methoden in der organischen Chemie" ("Spectroscopic Methods in Organic Chemistry"), Georg Thieme Verlag Stuttgart (1971).

To increase the peel strength of the activator or metal coating, the said host molecules can additionally be provided with another functional group.

In certain cases, a very good adhesion of the substrate surface is achieved with the other functional group, it being possible for this adhesion to revert to chemical reaction with the substrate surface or to adsorption or absorption.

Groups which are particularly suitable for chemical anchoring of the activator to the substrate surface are functional groups such as carboxylic acid groups, carboxylic acid halide groups, carboxylic acid anhydride groups, carboxylic acid ester groups, carboxamide and carboximide groups, aldehyde and ketone groups, ether groups, sulphonamide groups, sulphonic acid groups and sulphonate groups, sulphonic acid halide groups, sulphonic acid ester groups, halogen-containing heterocyclic radicals, such as chloro-triazinyl, -pyrazinyl, -pyrimidinyl or -quinoxalinyl groups, activated double bonds, such as in vinylsulphonic acid or acrylic acid derivatives, amino groups, hydroxyl groups, isocyanate groups, olefine groups and acetylene groups, and mercapto groups and epoxide groups, and furthermore higher chain length alkyl or alkenyl radicals from $C_8$, in particular oleyl, linoleyl, stearyl or palmityl groups.

If no anchoring takes place through a chemical reaction, the adhesion can also be effected by absorption of the organometallic activators onto the substrate surface, possible causes of the absorption being, for example, hydrogen bridge bonds or van der Waals forces.

It is advantageous for the functional groups which cause adsorption to be matched to the particular substrate. Thus, for example, long-chain alkyl or alkenyl groups in the activator molecule improve adhesion to substrates consisting of polyethylene or polypropylene. In contrast, activators with, for example, additional carbonyl or sulphonyl groups are particularly advantageous for metallisation of articles based on polyamide or polyester.

Functional groups such as carboxylic acid groups and carboxylic acid anhydride groups are particularly suitable for anchoring the activator to the substrate surface by adsorption.

In carrying out the new activation process in practice, a procedure is in general followed in which the substrate surfaces to be metallised are wetted with a solution of the selective metal complex in a suitable organic solvent, the solvent is removed and, if appropriate, sensitisation is carried out with a suitable reducing agent. Thereafter, the substrate thus pretreated, can be metallised in a customary metallising bath.

Apart from those mentioned above, suitable solvents are perchloroethylene, 1,1,1-trichloroethane, $CH_2Cl_2$, n-hexane, petroleum ether, cyclohexanone, alcohols, such as n-butanol, isopropanol and tert.-butanol, ketones, such as methyl ethyl ketone, aldehydes, such as n-butan-1- al, DMF and DMSO.

If the organometallic compound contains ligands which allow chemical fixing to the substrate surface, activation from the aqueous phase may also be possible.

Suitable reducing agents for the sensitisation are aminoboranes, alkali metal hypophosphites, alkali metal borohydrides, hydrazine hydrate and formalin. The substrates can be wetted by spraying, pressing, soaking or impregnating.

In order to increase the adhesion of the metal coating to the carrier surface, solvents or solvent mixtures which lead to partial dissolving or partial swelling of the plastic surface to be metallised are particularly preferably used for carrying out the process according to the invention.

By the influence of the activator systems with their characteristic swelling action on the substrates, a type of "adhesion seeding" is achieved, which can perhaps be thought of as intermediate spaces, which are accessible to the activation nuclei and to which the metals deposited during electroless metalli ation are anchored, being formed on the substrate surface.

The surface modification caused by the "swelling adhesion seeding" manifests itself by a change in light separation, turbidity, light transmission (in the case of transparent films and sheets) or a change in layer thickness, or in the form of cracks, caverns or vacuoles in scanning electron micrographs.

The swelling agent suitable for the particular polymer substrate to be metallised must be determined from case to case by corresponding preliminary experiments. A swelling agent has optimum properties if it partially swells the surfaces of the substrate within reasonable times without completely dissolving the substrate or even only having an adverse influence on its mechanical properties, such as notched impact strength, and without modifying the organometallic activators.

Suitable swelling agents are the so-called solvents and their blends with precipitating agents, such as are described, for example, in "Polymer Handbook" J. Brandrup et al., New York, IV, 157–175, (1974).

The solvent is removed from the wetted substrates simply by evaporation or, in the case of higher-boiling compounds, by extraction.

In a preferred process variant, the activation baths are monitored with a photometer as a detector. The wavelength of the filter here should correspond to the probable absorption maximum of the solution. The measurement signal is recorded by a compensation recorder and is called in by a clock in a cycle of 0.1 second to several minutes. The components which are lacking (solvent, activator) can thus be metered in with the aid of a computer.

An especially preferred embodiment of the process according to the invention comprises carrying out the reduction in the metallising bath directly using the reducing agent from the electroless metallisation. This embodiment is especially suitable for nickel baths containing aminoborane or copper or silver baths containing formalin.

Baths with Ni, Co, Cu, Au or Ag salts or mixtures thereof with one another or with iron salts are particularly suitable as metallising baths which can be employed in the processes according to the invention. Such baths are known in the technique of electroless metallisation of plastics.

Suitable substrates for the process according to the invention are: steels, titanium, glass, aluminium, textiles and sheet-like structures based on natural and/or synthetic polymers, ceramics, carbon, paper, thermoplastics, such as polyamide types, ABS (acrylonitrile/-butadiene/styrene) polymers, polycarbonates, polypropylene, polyesters, polyethylene and polyhydantoin, thermosetting resins, such as epoxy resins and melamine resins, and mixtures thereof or copolymers.

Without limiting the scope of the process according to the invention, it is advisable to observe the following parameters when carrying out the process:

the compounds employed for activation of substrate surfaces should not lead to irreversible destruction of the metallising bath.

The substituents which are capable of light absorption should not prevent fixing of the activators onto the substrate surface.

The substituents which are capable of light absorption should not prevent complexing of the carrier molecule with elements of sub-groups 1 and 8.

The said elements should not undergo such a powerful interaction with host ligands that they prevent catalysis for chemical deposition of the metal.

The solvents used should not have intrinsic absorption in the absorption range of the activator, must be easy to remove and should not lead to chemical degradation of the organometallic compound or complete solution of the substrate.

In order to achieve adequate activation, the activation time should be from some seconds to some minutes.

EXAMPLE 1

1 l of $CH_2Cl_2$ (technical grade), which also additionally contains 2.5 g of 1,4,7,10,13-pentaoxycyclododecane are added to 17.5 g of aqueous $Na_2PdCl_4$ solution (Pd content: 1.5% by weight) at RT (room temperature). The mixture is subsequently stirred for 10 minutes, before the aqueous phase is separated off from the organic phase. A red-brown homogeneous activator solution is obtained. A sheet of plastic made from commercially available polyester and having dimensions of 15×10 cm and a thickness of 3 mm is treated with this solution for 3 minutes. The substrate thus activated is dried and then metallised in an electroless nickeling bath which contains 30 g/l of $NiSO_4 \cdot 5H_2O$, 15 g/l of a 2N dimethylaminoborane solution, 11.5 g/l of citric acid and 3.0 g/l of boric acid and is brought to pH 7.9 with ammonia. After 20 minutes, a uniform nickel coating with a metallic shine and an electrical conductivity is deposited on the substrate surface.

COMPARISON EXAMPLE 1 l of $CH_2Cl_2$ (technical grade) is added to 17.5 g of aqueous $Na_2PdCl_4$ solution (Pd content: 1.5% by weight) and the mixture is subsequently stirred for 120 minutes (no reaction!). The sodium tetrachloropalladinite thereby remains in the aqueous phase. The activity of the colourless organic phase is tested, in accordance with Example 1, for the wet chemical metallisation. In spite of treatment in a chemical metallising bath for 120 minutes, no Ni can be deposited on the substrate surface.

EXAMPLE 2

A glass fibre-reinforced (30% by weight) sheet of plastic consisting of polyamide 6, 90×150 mm in size and 3 mm thick, is subjected to adhesion activating in an activation bath containing 1,500 ml of $CH_2Cl_2$ and 2.5 g of 1,4,7,10,13-pentaoxycyclododecane-sodium tetrachloropalladinite at RT for 5 minutes and is dried. The sheet is then sensitised in a bath consisting of 1,200 ml of ethanol, 450 ml of $H_2O$, 24 ml of $NH_3$ solution (25% strength), 50 ml of 2N DMAB (dimethylaminoborane) and 125 g of $CaCl_2$ at RT for 5 minutes, rinsed with distilled water and then nickeled in a conventional hypophosphite-containing nickeling bath from Blasberg AG, Solingen, at 35° C. for 25 minutes. The adhesion of the metal coating, determined by the peel strength according to DIN No. 53,494, is 40 N/25 mm. The electroplating reinforcing of the abovementioned polyamide sheet for determination of the peel strength was carried out as follows:

(a) etching for half a minute in 10% strength $H_2SO_4$, (b) rinsing, (c) 5 minutes in a semi-gloss nickel bath, voltage of 9 volts, bath temperature of 60° C.,(d) rinsing, (e) etching for half a minute, (f) 90 minutes in a copper bath; voltage of 1.9 volts, bath temperature of 28° C., (g) rinsing.

The preparation of 1,4,7,10,13-pentaoxycyclododecanesodium tetrachloropalladinite 5 l of $CH_2Cl_2$ containing 0.9 mole of 1,4,7,10,13-pentaoxycyclodecane are added to 0.3 mole of $Na_2PdCl_4$ in 1 l of $H_2O$ distilled at 40° C. and the mixture is subsequently stirred for 1.5 hours and then cooled. The organic phase is separated off from the aqueous phase. After filtration, the solvent is removed from the organometallic compound in vacuo. The new compound is then recrystallised from toluene and $CH_2Cl_2$ (1:1% by volume). A red-brown crystalline compound with a decomposition point of ~255° C. is obtained. In $CH_2Cl_2$, it has an absorption maximum at $21\times10^3$ $cm^{-1}$ in the UV range.

EXAMPLE 3

A commercially available glass matt-reinforced epoxy resin sheet 20×100×2 mm in size is activated according to Example 1, sensitised according to Example 2 and then coppered in a commercially available coppering bath for 20 minutes. A continuously coppered sheet of plastic is obtained.

EXAMPLE 4

1 l of petroleum ether (technical grade) which also additionally contains 2.7 g of the crown ether of the formula

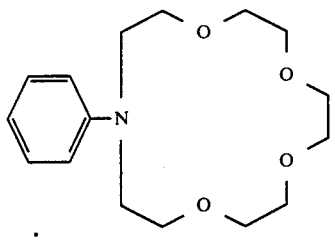

is added to 15 g of aqueous $Li_2PtCl_6$ solution (Pt content: 1.6% by weight) at 30° C. and the mixture is subsequently stirred for 20 minutes. The aqueous phase is then separated off from the organic phase.

A dark-coloured homogeneous activation solution is obtained. A sheet of ABS having the dimensions 100×100×2 mm is treated with this solution for 5 minutes. The test piece thus activated is dried at RT, sensitised according to Example 2 and then nickeled according to Example 2. An electrically conductive metal coating is obtained.

EXAMPLE 5

A square of knitted polyester cotton mixed fabric 10×10 cm in size is immersed at RT for 20 seconds in an activation bath prepared from 2.9 g of the crown ether of the formula

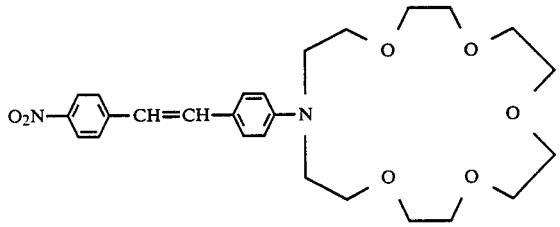

1 l $CH_2Cl_2$ and 1.0 g of a hydrochloric acid solution of $KAuCl_4$ (Au content: 20% by weight) by stirring for 20 minutes, and the fabric is then subjected to electroless nickeling in a commercially available nickeling bath from Shipley AG, Stuttgart. After a few seconds, the surface starts to acquire a metallic gloss colour. After 20 minutes, ~20 g of metal/$m^2$ have been deposited.

EXAMPLE 6

An injection-moulded sheet, 200×100×2 mm in size, of an acrylonitrile/butadiene/styrene polymer is subjected to adhesion activation in an activation bath consisting of 500 ml of petroleum ether, 200 ml of ethanol and 2 g of 1,4,7,10,13,16-hexaoxacyclooctadecane-sodium tetrachloropalladinite in the course of 5 minutes, and is dried in air and treated in a sensitising bath consisting of 450 ml of $H_2O$, 25 ml of DMAB solution (2N, aqueous), 15 ml of NaOH solution (~45% strength, aqueous) and 10 g of hydroxylamineammonium chloride for 5 minutes.

The activator adheres so firmly to the substrate surface that, in spite of subsequent treatement with a commercially available concentrated NaOH solution (~45% strength) to free the injection-moulded component from grease residues and mould release agents, it cannot be removed.

The test piece thus activated can then be provided with a firmly adhering chemically electroplated metal coating according to Example 2.

Preparation of 1,4,7,10,13,16-hexaoxacyclooctadecane-sodium tetrachloropalladinite 5 l of pure $CH_2Cl_2$ containing 0.2 mole of 1,4,7,10,13,16-hexaoxacyclooctadecane are added to 0.1 mole of $Na_2PdCl_4$ (anhydrous), the mixture is subsequently stirred at the boiling point for 30 minutes and filtered and the filtrate is then cooled. The solvent is removed from the organometallic compound in vacuo. The new compound is then recrystallised from purified 1,1,1-trichloroethane. A red-brown crystalline compound with a melting point of 223° C. is obtained. A solution thereof in $CH_2Cl_2$ has an absorption maximum at $22\times10^3$ $cm^{-1}$ in the UV range.

EXAMPLE 7

An injection-moulded, commercially available sheet of polyamide 6, 200×100×3 mm in size, is activated in an activation bath consisting of 1000 ml of $CCl_2=CCl_2$, 0.01 mole of 1,4,7,10,13,16-hexaoxacyclooctadecane and 0.005 mole of $H_2PtCl_6$ for 5 minutes and is sensitised according to Example 2 and then chemically nickeled and reinforced by electroplating according to Example 2. A polymer/metal laminate with good adhesion of the metal is obtained.

Preparation of 1,4,7,10,13,16-hexaoxacyclooctadecane-hexachloroplatinic acid 8 l of $CH_2Cl_2$ (subsequently purified) containing 2 moles of 1,4,7,10,13,16-hexaoxacyclooctadecane are added to 0.1 mole of $H_2PtCl_6$, the mixture is subsequently stirred at 40° C. for 30 minutes and filtered * and the solvent is then removed from the organometallic compound in vacuo. The new compound is then recrystallised from $CH_2Cl_2$ and $CCl_2=CCl_2$ (1:1% by volume). An orange-yellow compound with a decomposition point of 133° C. is obtained. In $CH_2Cl_2$, it has an absorption maximum at $37\times10^3$ $cm^{-1}$ in the UV range.

EXAMPLE 8

A sheet of polyamide 6,6, 200×100 ×3 mm in size, is activated in an activation bath consisting of 1000 ml of $CCl_3$—$CH_3$, 0.01 mole of 1,4,7,10,13-pentaoxocyclododecane and 0.005 mole of $H_2PtCl_6$ for 5 minutes, and is sensitised according to Example 2 and then chemically nickeled and reinforced by electroplating according to Example 2. A polymer/metal laminate with good adhesion of the metal is obtained.

Preparation of 1,4,7,10,13-pentaoxocyclododecane-hexachloroplatinic acid 8 l of $CH_2CCl_2$ (subsequently purified) containing 0.2 mole of 1,4,7,10,13,16-hexaoxacyclooctadecane are added to 0.1 mole of $H_2PtCl_6$, the mixture is subsequently stirred at 40° C. for 30 minutes and concentrated to dryness in vacuo and the residue is then recrystallised from $CH_2Cl_2$ and toluene (1:0.25% by volume). An orange compound with a decomposition point of 163° C. is obtained. In $CH_2Cl_2$, it has an absorption maximum at $42\times10^3$ $cm^{-1}$.

EXAMPLE 9

A knitted polyester/cotton mixed fabric 10×10 cm in size is immersed at RT for 60 seconds in an activation bath which consists of 0.01 mole of guest/host molecule based on 0.01 mole of 1,4,7,10,13,16-hexaoxacyclooctadecane and 0.01 mole of $HAuCl_4$ and has an absorption maximum at $31\times10^3$ $cm^{-1}$ in the UV range, and is then nickeled according to Example 5. After a few minutes, the surface starts to become a metallic gloss colour. After 18 to 20 minutes, ~20 g of metal/$m^2$ have deposited. The abovementioned yellow compound has an indefinite melting point of 123° C.

EXAMPLE 10

A knitted cotton fabric 10 cm×10 cm in size is activated at RT for 45 seconds in an activation bath consisting of a guest/host molecule based on 0.005 mole of 1,4,7,10,13-pentaoxacyclododecane and 0.005 mole of $HAuCl_4$ in $CH_3CCl_3$, and is dried and then coppered in a commercially available coppering bath. A glossy, electrically conductive Cu coating which adheres well is deposited on the surface of the sample in the course of about 15 minutes.

The complex compound employed has an indefinite melting point at 97° C. and a UV absorption maximum at $51\times10^3$ $cm^{-1}$.

We claim:

1. In a process of activating substrate surfaces for electroless wet chemical metallisation using a solution of an organometallic compund based on elements from sub-group 1 or 8 of the periodic system in an aprotic solvent, the improvement comprising that said activation bath solution contains an organometallic compound with a "host/guest" interrelationship and wherein the host molecule which is capable of complex formation in the organometallic compound is selected from crown ethers, cryptands or podands.

2. A process according to claim 1, wherein the selective complex ligand or the host molecule in the organometallic compound is a cyclic compound which, in the presence of the medium to be complexed, assumes the structure required for complex formation or host/guest interaction.

3. A process according to claim 1, wherein the host molecule contains cyclic crown ethers of the formulae

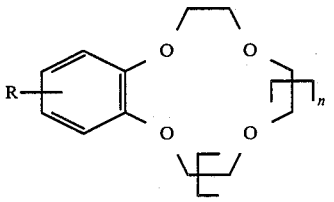

n=0–4

R=alkyl, aryl, halogen and the like

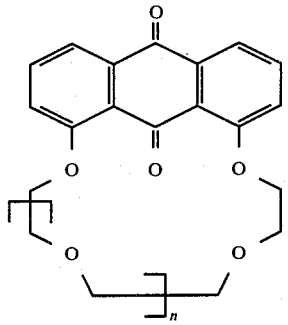

n=0–4

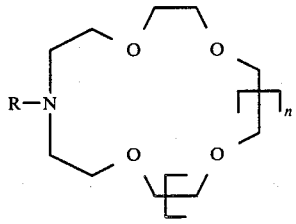

n=0–4

R=alkyl or aryl; for example methyl, ethyl, phenyl, biphenyl, phenylazophehyl and the like.

4. A Process according to claim 1, wherein the selective complex ligand and the host molecule in the organometallic compounds have a pure hydrocarbon structure.

5. A Process according to claim 1, wherein the host molecules of the organometallic compounds contain additional functional groups.

6. A Process according to claim 1, wherein the medium to be complexed in the host/guest molecules is a compound of the formula $$[Me^{n+}E^{m+}Hal_z]$$

wherein

Me represents hydrogen, alkali metal, alkaline earth metal or heavy metal atoms or represents $NH_4$, Hal represents halogen and E represents a noble metal atom of sub-groups 1 and 8 of the periodic system with a valency of m and a coordination number of z, wherein $$z-m=n.$$

7. A process according to claim 1, wherein the guest molecule to be complexed is a compound from selected $H_2PdCl_4$, $Na_2(PdCl_2Br_2)$, $Na_2PdCl_4$, Ca $PdCl_4$, $Na_4(PtCl_6)$, $AgNO_3$ and CuCl.

* * * * *